United States Patent [19]

Krabbe

[11] 4,298,230

[45] Nov. 3, 1981

[54] TUNNELLING APPARATUS

[75] Inventor: Wilfried Krabbe, Dreieich-Buchschlag, Fed. Rep. of Germany

[73] Assignee: Philipp Holzmann Aktiengesellschaft, Fed. Rep. of Germany

[21] Appl. No.: 158,997

[22] Filed: Jun. 12, 1980

[30] Foreign Application Priority Data

Jun. 25, 1979 [DE] Fed. Rep. of Germany ..... 2925505

[51] Int. Cl.[3] ..... E21D 9/10

[52] U.S. Cl. ..... 299/33; 299/58; 299/90

[58] Field of Search ..... 299/31, 33, 58, 55, 299/61, 90; 175/258

[56] References Cited

U.S. PATENT DOCUMENTS 3,350,889 11/1967 Sturm ..... 299/56
3,404,920 10/1968 Taber ..... 299/31
3,830,545 8/1974 Sugden ..... 299/33

FOREIGN PATENT DOCUMENTS 2431512 9/1975 Fed. Rep. of Germany .
2745447 4/1979 Fed. Rep. of Germany ..... 299/56

*Primary Examiner*—William F. Pate, III
*Attorney, Agent, or Firm*—Scully, Scott, Murphy & Presser

[57] ABSTRACT

A tunnelling apparatus has an annular tunnelling element subdivided into a leading and a trailing chamber. The front end of the leading chamber is open to the material-removing face. A material-removing cutting device is lodged in an opening formed in the transverse wall to remove material from the working face. It can be axially withdrawn from the opening into and if necessary rearwardly beyond the trailing chamber, so as to expose the opening and permit access of an operator to the working face through the opening.

8 Claims, 5 Drawing Figures

TUNNELLING APPARATUS

BACKGROUND OF THE INVENTION

The present invention relates to tunnelling apparatus, i.e., with apparatus for driving a tunnel in the ground.

Tunnelling apparatus of the general type here in question is already known from German Pat. No. 2,431,512. This type of equipment has a generally annular tunnelling element at the front end of which there is provided a working chamber the forward end of which is open and which is formed by providing a transversely extending wall which subdivides the tunnelling element into the forward or leading working chamber and a rearward or trailing chamber. Mounted in the working chamber is a material-removing device which extends through the front open end of the tunnelling element and removes material from the soil face just ahead of the tunnelling element. A pressurizable flowable medium can be introduced into the working chamber in order to support the soil face against collapse. In the type of equipment disclosed in the aforementioned German patent, it has been found that from time to time it may become necessary to gain access to the working chamber, either by the admission of a worker into the chamber or by the introduction of tools into the chamber, because obstacles may be encountered in the soil by the material-removing device which the device itself cannot remove or reduce to smaller manageable portions, respectively. This may, for example, be large rocks, buried tree trunks, tree roots or the like. In order to gain access to the working chamber, it is necessary to withdraw the supporting medium which may be thixotropic fluid. After this is done, an operator may gain access to the chamber through an appropriate port. This presents no particular problems if the tunnels are of large diameters, for example, the type of tunnel required for the contruction of subways. In the case of small tunnels having a diameter of only about 0.8–1.5 meters, such as is for example required for large waste-water mains, the relatively large space requirements of the material removal device within the working chamber make it impossible for a worker to enter the chamber, for lack of space. Nevertheless, the problems which occasionally make it necessary to gain access to the working chamber are just as acute in the case of small-diameter tunnels as in the case of large-diameter tunnels.

SUMMARY OF THE INVENTION

Accordingly, it is an object of the present invention to provide further improvements in the type of apparatus mentioned above, and which make it possible to gain access to the working chamber even in the case of relative small-diameter tunnels.

In keeping with these objects, and with still others which will become apparent hereafter, one feature of the invention resides in tunnelling apparatus which, briefly stated, comprises an annular tunnelling element; wall means subdividing this element into a trailing chamber and a leading chamber having an open front end; material-removing means in said leading chamber to remove material located adjacent the front end; and means detachably mounting said material-removing means for retraction substantially axially of said element from said leading chamber at least into said trailing chamber.

In an apparatus according to the present invention, access can be had to the leading working chamber, if and when necessary, by reducing the pressure of the supporting medium—of if the supporting medium is a thixotropic liquid, by lowering the level of the thixotropic liquid to approximately half the height of the working chamber—and retracting the material-removing device so that the opening in the transverse wall of the tunnelling element in which the material-removing device was previously located, is now exposed. An operator can then approach this opening from the rear or trailing chamber and either climb through the opening into the working chamber or, if this is not necessary or desired, insert his arms and appropriate tools through the opening into the working chamber and work on the obstruction, for example, to break up the obstruction into smaller pieces which can be removed through the opening.

If the tunnel diameter—and accordingly the diameter of the annular tunnelling element—is particularly small so that an operator can not readily pass the material-removing device while it is located in the trailing chamber, then the device can be retracted—for which purpose an appropriate carriage is provided—out of the trailing chamber and along the length of the tunnel until a wider space or an access tunnel which is wider can be reached. It is simply necessary to take up—advantageously continuously—the energy supply lines and pressure-fluid supply lines and similar lines or hoses, and subsequently to reel them out again when the material-removing device is restored to its working position. The opening for the material-removing device, and through which an operator can gain access to the working chamber, may have an area smaller or coextensive with the area of the transverse wall separating the leading and trailing chambers.

The invention will hereafter be described with reference to exemplary embodiments. It is to be understood, however, that it is not limited thereto.

DESCRIPTION OF PREFERRED EMBODIMENTS

Figure 1:
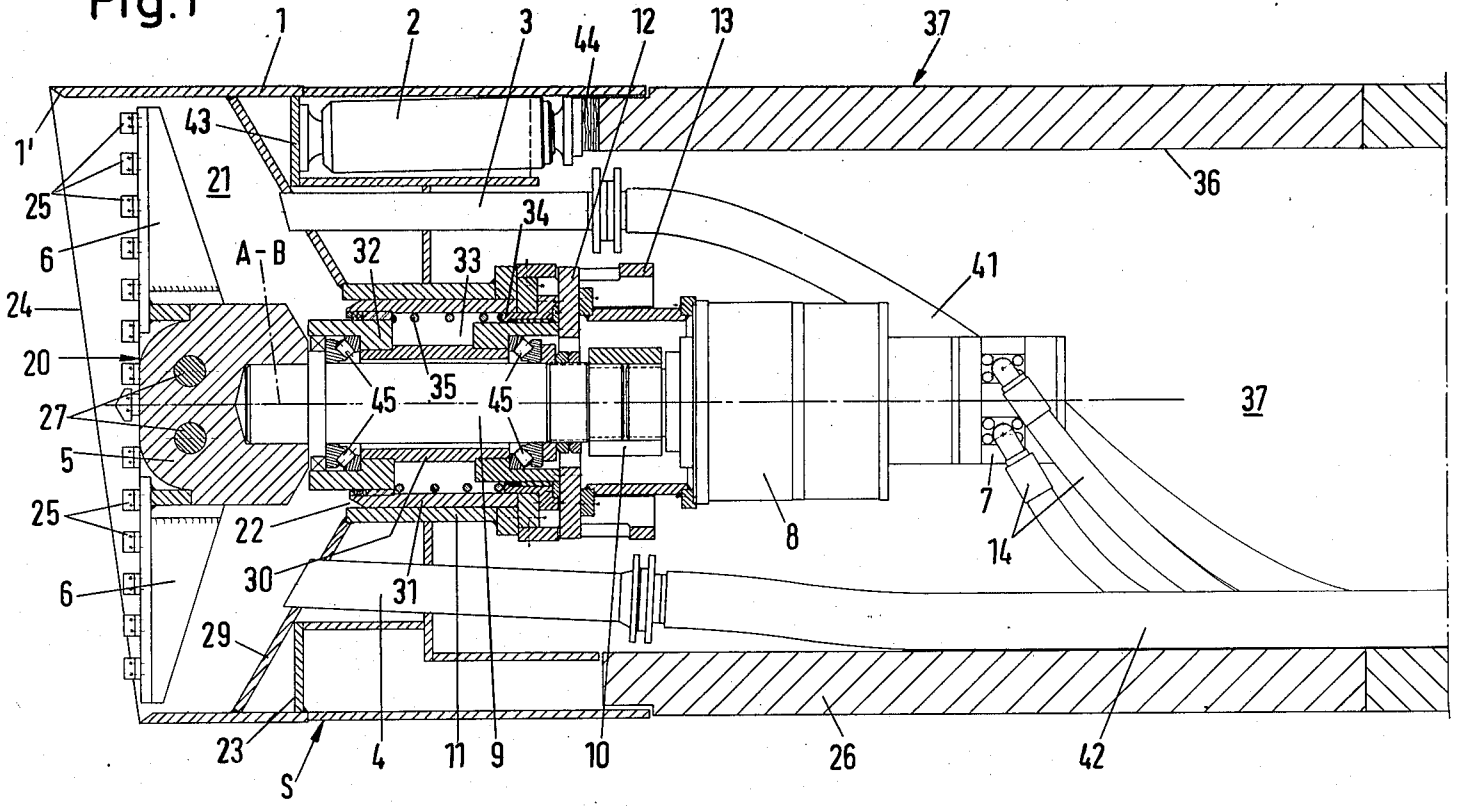
FIG. 1 is a longitudinal section showing a tunnelling apparatus according to the present invention in working position.
Figure 2:
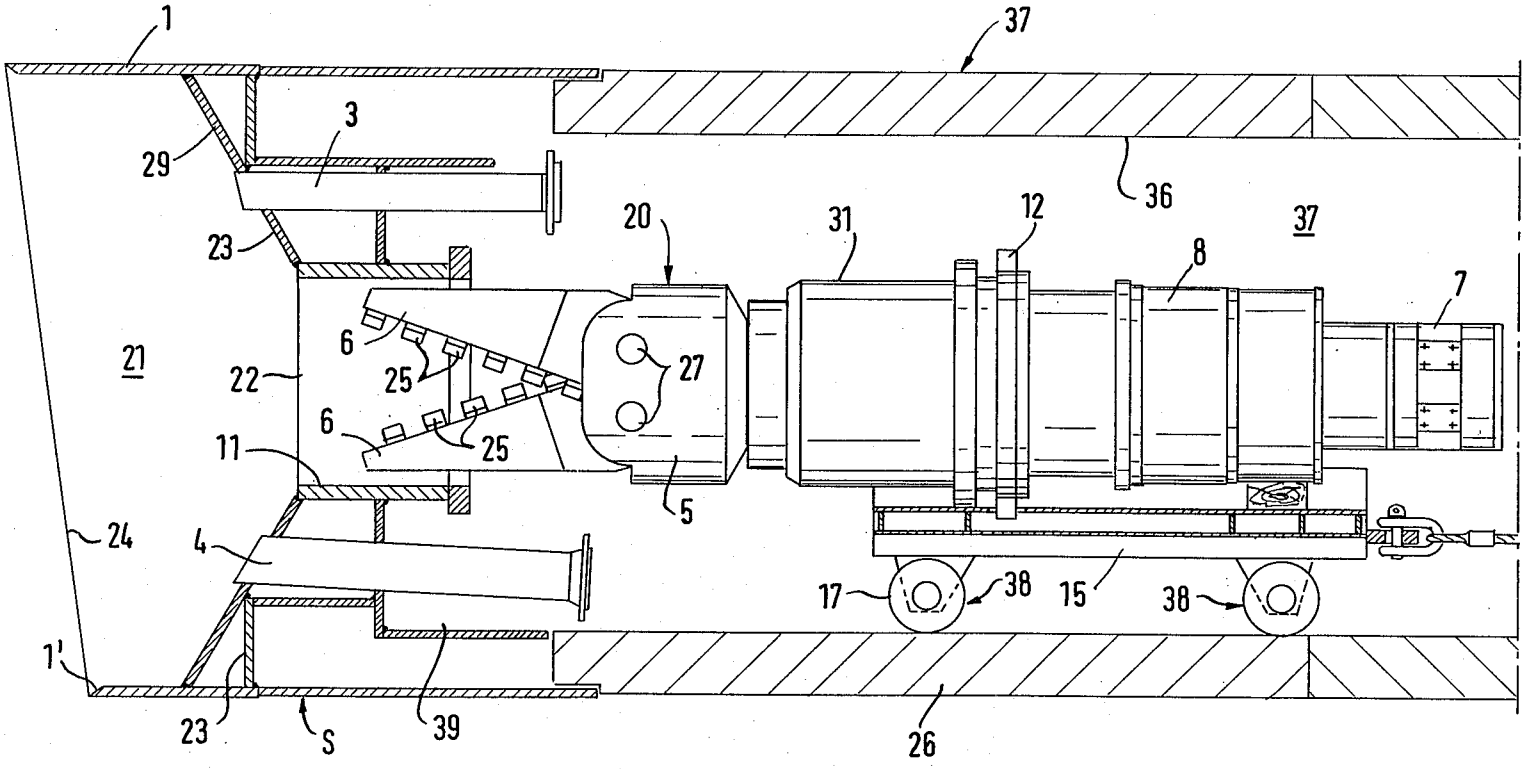
FIG. 2 is a view analogous to FIG. 1, but showing the same apparatus in retracted position.
Figure 3:
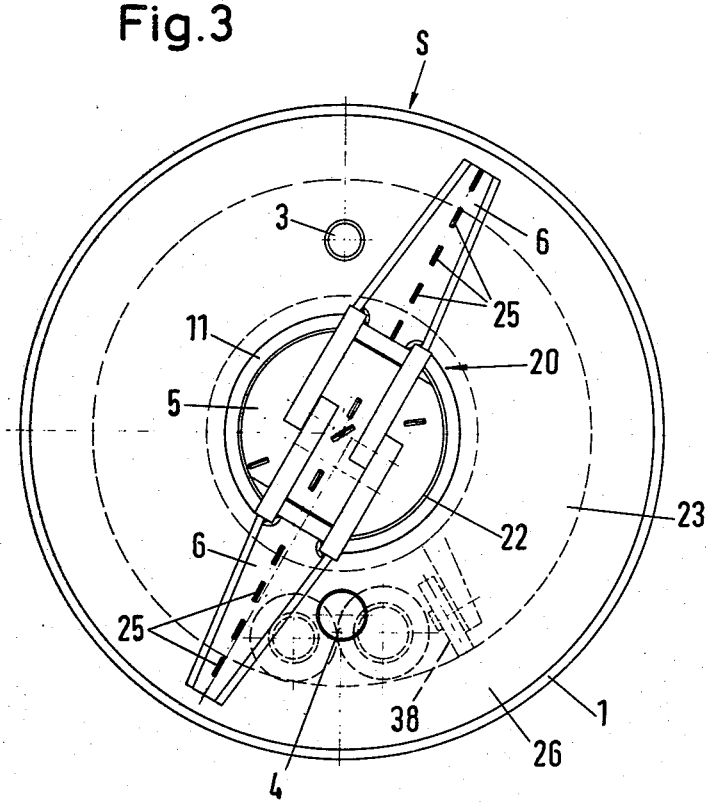
FIG. 3 is a front view of the apparatus in FIG. 1, looking towards the right in FIG. 1.

Referring now firstly to the embodiment illustrated in FIGS. 1–3, it will be seen that reference numeral 1 identifies the annular tunnelling element of the apparatus S, which element is constructed as a double wall having an open front end provided with a cutting or sealing edge 1'. It is subdivided by a forwardly located transverse wall 23 into a leading working chamber 21 and a trailing chamber located behind the transverse wall 23 and which is sealed from the working chamber 21. The working chamber 21 extends to the working face 24, i.e. to the soil into which the tunnel is to be driven, and accommodates a material-removing device 20 which removes the material from the working face 24 in order to drive the tunnel. The chamber 21 is filled with a supporting medium, for example a thixotropic liquid, which prevents break-in of the material of the working face 24. For this purpose, the upper part of the apparatus S is provided with an inlet pipe 3 through which the liquid is introduced into the chamber 21 to be kept therein under a certain pressure, the quantity of the liquid being maintained constant in the chamber 21 by pumping additional liquid into the chamber as required, via a supply line 41 and the inlet pipe 3.

The material removing device 20 has a driven cutting tool which is movable in the supporting medium accommodated in the chamber 21. The material removed from the working face 24 is withdrawn via a material outlet pipe 4 and a conduit 42, for which purpose a pump or similar device may be arranged in the non-pressurized part of the apparatus S, or it may be located behind the apparatus S in the actual tunnel 37 that has already been formed.

A comparison of FIGS. 1 and 2 shows that the material removing device 20 is mounted in an opening 22 of the apparatus S, so that it can be retracted rearwardly in the direction of the longitudinal axis A of the tunnelling element 1, thereby exposing the opening 22 and affording access to the chamber 21 and thus to whatever obstruction may be located at or in the working face 24. The area of the opening 22 may correspond or substantially correspond to the area of the wall 23 as shown in FIG. 3 or it may be smaller, as shown in FIGS. 1 and 2.

A cylindrical sleeve like guide tube 11 extends rearwardly from the edge of the circular opening 22, in a direction towards the already finished tunnel 37. The material removing device 20 is axially movably mounted in the tube 11, in a supporting structure 16, 31, having a cylindrical external contour, so that it can be moved rearwardly, i.e., lengthwise of the axis A and away from the working face 24.

As the drawing shows, the material removing device 20 has a drive shaft 9 which extends either horizontally or is slightly inclined to the horizontal, and projects in the direction towards the working face 24. The free end of the drive shaft 9 carries a cutting head 5 from which two cutting arms 6 project which extend essentially diametrically of one another and at right angles to the axis B of the drive shaft 9 when in their working position. These arms 6 are provided with tools or cutting elements 25 facing towards the working face 24, for example picks or the like. The shaft 9 is driven via a coupling 10 and a drive 8 (preferably but not necessarily a planetary gear drive) by a motor 7 which again preferably, but not necessarily, is a hydraulic motor. Energy supply lines 14 or hydraulic lines in the case of a hydraulic motor, supply motive power to the motor 7; if the motor 7 is a hydro motor they supply pressurized oil from a hydro aggregate mounted somewhere rearwardly there is adequate space.

As already mentioned, rearwardly of the apparatus S is the already finished tunnel 37, the wall 36 of which may be composed of a series of circular cross section pipes or tubes which are axially adjacent one another as shown in FIGS. 1 and 2. Thus, the apparatus S is to be considered as the leading end or tip of a string of such tubes 36. The actual advancing force is produced at the trailing end (not shown) of the string of tubes 36, for example in a larger-diameter working station or intermediate station, or from a tunnel with a larger diameter, by means of appropriate hydraulic rams or the like which push the entire string of tubes 36 forwardly. The string of tubes 36 may have a length of between approximately 30–80 meters without requiring an intermediate station.

Located at the leading end of the apparatus S are hydraulic presses 2 which bear with their forward part against an axial abutment 43 of the element 1 located in the vicinity of the cutting and sealing edge 1', and which bear with their rear ends against a pressure ring 44 (see FIG. 1) located ahead of the front end of the rearwardly adjacent pipe 36 of the tunnel 37. The control of the presses 22 is effected by a not illustrated control conduit (forming no part of the invention) from the operating station, since the top of the tunnel here in question has so small a diameter that it is often not possible for presonnel to enter into it except with considerable difficulty. The presses 2 may be arranged—for example in the embodiment of FIG. 5 which will be described later—in e.g. four groups of three presses each. In this manner, the movement of the apparatus S can be guided in all directions (upwardly, downwardly, left and right) depending upon which of the presses 2 receive pressure fluid.

Figure 4:
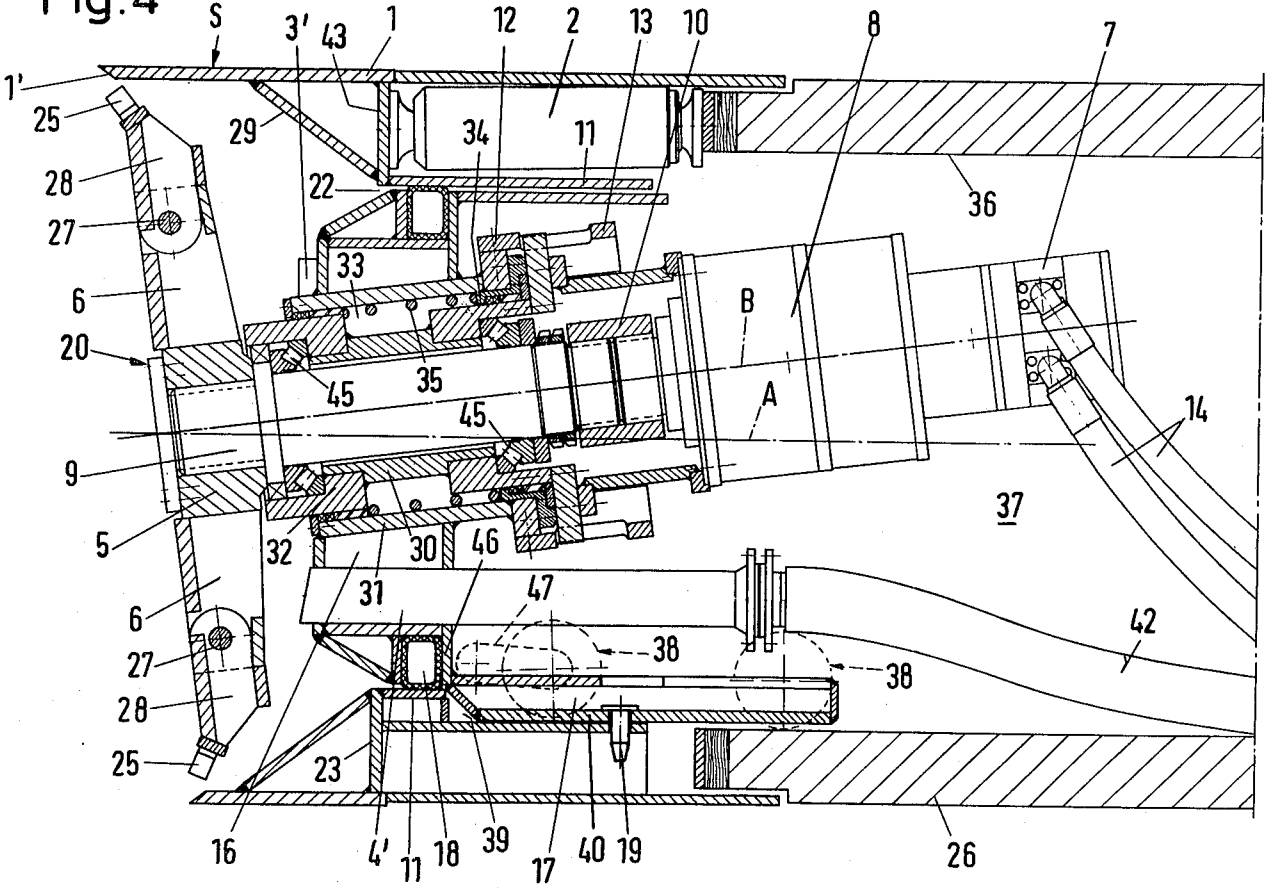
FIG. 4 is a view similar to FIG. 1 but illustrating a different embodiment of the invention.

In radial direction, the cutting arms 6 of the device 20 have, when in operating position as shown in FIG. 1, an elongation which is greater than the radius of the opening 22 and thus of the tube 11. To permit these arms 6 to pass through the opening 22 when the device 20 is to retracted, the arms 6 can be reduced in their length to a rest position length which is smaller than the radius of the opening 22. For this purpose, they have a pivot axis 27 about which that part 28 of each arm which exceeds the rest position dimension can be pivoted in the direction towards the axis B of the drive shaft 9. For this purpose, the arms 6 may be subdivided as shown in FIG. 4, with the pivotable parts of the arms extending outwardly from the location of the subdivision at which the pivot axis 27 is provided. The pivot axes 27 each extend transversely to the elongation of the arms 6 and also transversely to the axes B of the drive shaft 9.

In the embodiment of FIGS. 1–3, the rest position dimension mentioned above corresponds to the radius of the drive shaft 9 or the radius of the cutting head 5 at the starting point of the cutting arms 6, respectively, where the pivot axes 27 are located in this embodiment. That portion of the arms 6 which extends beyond the rest position dimension and is formed in this particular embodiment by the entire length of the arms 6, so that the two pivot axes 27 are journaled in the drive shaft 9.

In either case, however, the displacement of the portions 28 of the arms 6 (FIG. 4) or of the entire arms 6 (FIGS. 1 and 2) makes it possible to retract the device 20 without hindrance through the tube 11 in rearward direction until the opening 11 is completely exposed.

The circumferential edge bounding the opening 22 is constructed as an abutment 29 which on passage of the device 20 through the opening 22 causes the inward tilting of the arm portions 28 respectively the entire arms 6, depending upon the particular embodiment. After an obstruction encountered in the chamber 21 has been removed, following access of an operator through the opening 22 to the working face 24, the device 20 is restored to the position shown in FIG. 1, whereupon the arms 6 or the parts 28 thereof are returned to their operating position mechanically or in other suitable manner, for example pneumatically, hydraulically or electrically. The abutment 29 is formed in this embodiment by a calotte-shaped portion of the wall 23 which extends forwardly and outwardly from the edge of the opening 22 in the direction towards the circumferential wall of the annular tunnelling element 1.

The front portion of the drive shaft 9 which extends through the tube 11 is surrounded by a non-rotatable sleeve 30 in which the shaft 9 is turnably journaled, but relative to which the shaft 9 can not axially shift. The sleeve 30 itself is surrounded by a sleeve 31 which acts as a cylinder in which the sleeve 30—the outer circumference of which is enlarged in the manner of a piston 32—is axially displaceably accommodated. The annular cylinder space 33 defined between the sleeves 30 and 31 is filled with oil and connected to a pressure storage device. Thus, the oil in the space 33 acts as a spring. This spring effect can be further enhanced by providing a helical spring 35 which is located and reacts between the axially immovable annular end wall 34 of the space 33 at the piston-like enlargement 32 of the sleeve 30, in the space 33. The sleeve 31 also accommodates the bearings 45 for the drive shaft 9. The space 33 is connected with a control device (not shown and not forming a part of the invention) which, if a pressure increase in the space 33 takes place, increases the pressure of the device 20 which is directed forwardly towards the working face 24. In this manner, and assuming that an obstruction is encountered at the working face 24, the drive shaft 9 with the head 5 and the arms 6 can yield axially rearwardly, with the result that due to the displacement of the oil in the cylinder space 33 the pressure in the storage increases, which can be indicated on a suitable control panel supervised by the operator. In this manner, the working pressure of the arms 6 in the direction towards the working face 24 can then be increased purposely by the operator, in order to overcome an obstruction encountered at the working face 24. If this measure does not yield any result, then the device 20 is retracted in the direction of the axis A of the element 1, to expose the opening 22 for access to the chamber 21 by an operator.

The sleeve 30 is provided with a radial projection 12 serving as a torque support, which is associated with a stationary abutment 13 limiting the movement, i.e., the movement in axial direction of the sleeve 30.

Figure 5:
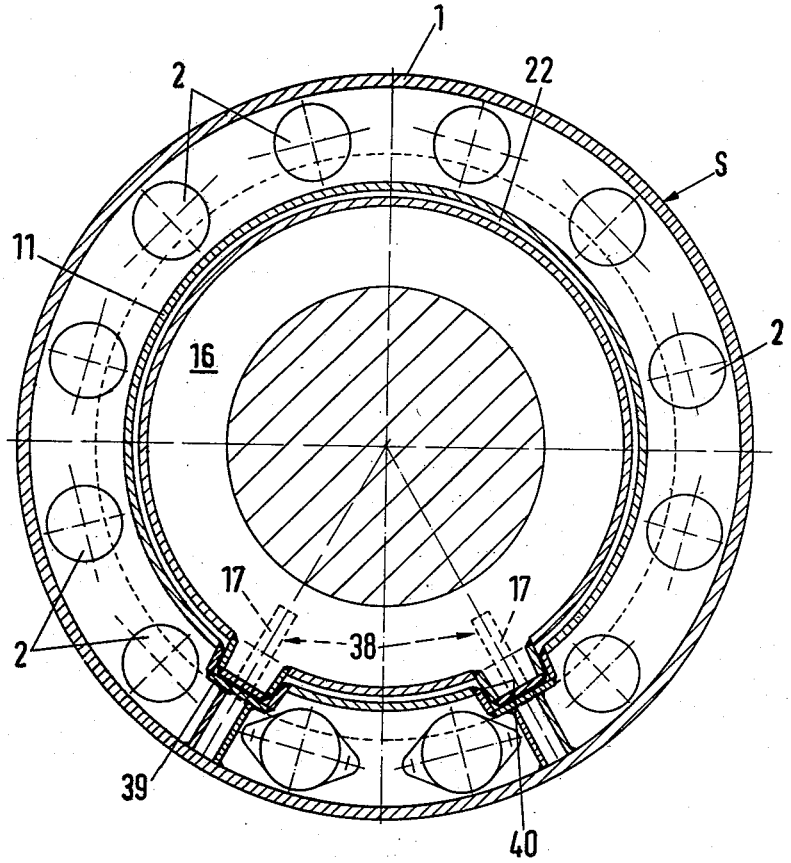
FIG. 5 is a cross section of the apparatus in FIG. 4.

In FIGS. 1-3, the sleeve 31 is directly axially movably respectively removably accommodated in the tube 11. In contradistinction thereto, the embodiment of FIGS. 4 and 5 provides for the sleeve 31 to be surrounded by a sleeve-like element 16 which is journaled in a guide tube 11 having a correspondingly larger diameter so that it can be moved axially rearwardly, i.e., in the direction of the longitudinal A of the element 1. This embodiment makes it possible for the longitudinal axis A of the element 1 and the longitudinal axis B of the drive shaft 9 to be so inclined relative to one another (see FIG. 4) that the drive shaft 9 which extends forwardly towards the working face 24 is slightly inclined in downward direction. In certain circumstances, for example in dependence upon the type of soil encountered at the working face 24, such a downward inclination can be advantageous.

To facilitate the movement of the drive 20 in the direction of the axis A of the element 1, the cutting device 22 has a carriage 38 associated with it which can move on the bottom respectively on the lower part 26 of the wall 36 of the tunnel 37, with the aid of wheels 17. To guide the device 38 in the region of the apparatus S, guide rails or grooves 39 may be provided for the wheels 17 behind the transverse wall 23 and connected thereto. A drive 47 for the wheels 17 at the left hand side in FIG. 4, is illustrated in that figure.

In addition, in the embodiment of FIGS. 4 and 5, the element 16 is provided with longitudinally extending external ribs 40 which extend into these rails 39. Furthermore, the element 16 has a latch or a lock 19 cooperating with the tube 11, so that the position of the device 20 in the operating position shown in FIG. 4 is assured. In a relatively simple manner, the embodiment of FIGS. 4 and 5 provides for the carriage 38 to be formed by wheels 17 which are mounted on the element 16 itself. A seal 18 is provided between the device 20 and the edge of the opening 22, which is in particular located between the element 16 and the guide tube 11 in an outer annular groove 46 of the element 16. The seal 18 may be, but not be, constructed as a hose of annular configuration (i.e., an endless hose) which can be somewhat expanded by admitting pressure fluid—preferably pressurized air—into it. Of course, before the device 20 can be retracted the pressure in the seal 18 must be released and the wheels 17 must be lowered.

In the embodiment of FIGS. 2 and 3, the carriage 38 is in the form of a separate carriage 15 which supports the entire device 20 and is provided with the wheels 17.

In the embodiment of FIGS. 1-3, the transverse wall 23 is provided with the inlet and outlet pipes 3,4 for connection to a fluid supply line 41 and a material removing line 42. In the embodiment of FIG. 4, however, the element 16 is provided with the inlet and outlet pipes 3',4' which extend axially through it and which can be connected to the lines 41 and 42, respectively.

During the retraction of the device 20, it is advantageous if in the embodiment of FIGS. 1-3, the energy supply lines 14 are disconnected from the motor 7 and are wound up. The hoses 41 and 42 and control lines can remain in place.

In the embodiment of FIG. 4 on the other hand, all of the lines 14, 41, 42 and any control lines must be continuously removed and wound up as the device 20 is retracted in rearward direction.

The supporting fluid, for example a thixotropic liquid or bentonit, is too expensive to be discarded. To recover it, i.e., to separate from the material that has been removed from the working face 24, it can be supplied to an appropriate installation which is advantageously provided above ground. This, however, is not part of the present invention. The pressure of the supporting medium can be controlled by means of sensors mounted in the apparatus S, but again this is not part of the invention.

It is advantageous if the parts 28 of the arms 6, or the entire arms 6 when they have been pivoted inwardly to the position of e.g. FIG. 2, can be arrested in this position until they are again required to return to their working position.

The invention has hereinbefore been described with reference to exemplary embodiments. However, it is susceptible of a variety of changes and modifications which are intended to be encompassed within the appended claims.

I claim:

1. A tunnelling apparatus comprising an annular tunnelling element; wall means subdividing said element into a trailing chamber and a leading chamber having an open front end; material-removing means in said leading chamber to remove material located adjacent the front end; said wall means being further defined as having an opening in which said material-removing means are normally located and which is opened when said material-removing means are withdrawn from said leading chamber; means detachably mounting said material-removing means for retraction substantially axially of said element from said leading chamber at least into said trailing chamber; said apparatus further comprising a bearing sleeve surrounding said shaft and in which said shaft is rotatable but axially fixed; a housing sleeve surrounding said bearing sleeve and in which said bearing sleeve is axially movable as a cylinder and defines an annular fluid chamber adapted to receive pressure fluid from a source.

2. Apparatus as defined in claim 1; and further comprising an axially acting biasing spring reacting between said sleeves.

3. Apparatus as defined in claim 1; further comprising a projection on said bearing sleeve and an abutment engagable with said projection to limit axial displacement of said bearing sleeve.

4. A tunnelling apparatus comprising an annular tunnelling element; wall means subdividing said element into a trailing chamber and a leading chamber having an open front end; material-removing means in said leading chamber to remove material located adjacent the front end; said wall means being further defined as having an opening in which said material-removing means are normally located and which is opened when said material-removing means are withdrawn from said leading chamber; means detachably mounting said material-removing means for retraction substantially axially of said element from said leading chamber at least into said trailing chamber; said apparatus further comprising a sleeve surrounding said opening and extending rearwardly from the same and a tubular housing surrounding said sleeve, said sleeve being disengagable and axially movable in said housing.

5. A tunnelling apparatus comprising an annular tunnelling element; wall means subdividing said element into a trailing chamber and a leading chamber having an open front end; material-removing means in said leading chamber to remove material located adjacent the front end; said wall means being further defined as having an opening in which said material-removing means are normally located and which is opened when said material-removing means are withdrawn from said leading chamber; means detachably mounting said material-removing means for retraction substantially axially of said element from said leading chamber at least into said trailing chamber; said apparatus further comprising a sleeve surrounding and extending rearwardly from said opening; a tubular member surrounding said sleeve, and a guide tube accommodating said tubular member for rearward movement of the same in said guide tube.

6. Apparatus as defined in either claim 1 or 5, said material-removing means including a drive shaft extending through said opening into said leading chamber, said shaft and opening having respective axes which are so inclined relative to one another that the axis of said shaft is somewhat downwardly inclined in direction from said opening towards said open front end.

7. A tunnelling apparatus comprising an annular tunnelling element; wall means subdividing said element into a trailing chamber and a leading chamber having an open front end; material-removing means in said leading chamber to remove material located adjacent the front end; said wall means being further defined as having an opening in which said material-removing means are normally located and which is opened when said material-removing means are withdrawn from said leading chamber; means detachably mounting said material-removing means for retraction substantially axially of said element from said leading chamber at least into said trailing chamber; a carriage adapted to support said material-removing means rearwardly of said wall means and being adapted to move along on a lower part of said tunnelling element; said carriage having wheels; and further having guide rails for those wheels connected to and extending rearwardly from said wall means; said material-removing means being located in a tubular member; outer ribs on said member extending lengthwise thereof, engaging in said guide rails to prevent turning of said tubular member.

8. A tunnelling apparatus comprising an annular tunnelling element; wall means subdividing said element into a trailing chamber and a leading chamber having an open front end; material-removing means in said leading chamber to remove material located adjacent the front end; said wall means being further defined as having an opening in which said material-removing means are normally located and which is opened when said material-removing means are withdrawn from said leading chamber; means detachably mounting said material-removing means for retraction substantially axially of said element from said leading chamber at least into said trailing chamber; a carriage adapted to support said material-removing means rearwardly of said wall means and being adapted to move along on a lower part of said tunnelling element; said carriage having wheels; and further having guide rails for those wheels connected to and extending rearwardly from said wall means; and locking means cooperating with said tubular member and with a sleeve located therein and housing said material-removing means.

* * * * *

UNITED STATES PATENT AND TRADEMARK OFFICE

CERTIFICATE OF CORRECTION

PATENT NO. : 4,298,230

DATED : November 3, 1981

INVENTOR(S) : Wilfried Krabbe

It is certified that error appears in the above-identified patent and that said Letters Patent are hereby corrected as shown below:

Column 1, line 33, after the word be, the word -- a -- should be inserted.

Column 7, line 13, after the word in, "Claim 1" should read as -- either Claims 1 or 5 --.

Column 7, line 16, after the word in, "Claim 1" should read as -- either Claims 1 or 5 --.

Column 8, line 3, after the word either, "Claim 1 or 5" should read as -- Claims 1 or 5 --.

Signed and Sealed this

*Eighteenth* Day of *May 1982*

[SEAL]

*Attest:*

GERALD J. MOSSINGHOFF

*Attesting Officer*

*Commissioner of Patents and Trademarks*